US006419553B2

(12) United States Patent
Koinkar et al.

(10) Patent No.: US 6,419,553 B2
(45) Date of Patent: Jul. 16, 2002

(54) METHODS FOR BREAK-IN AND CONDITIONING A FIXED ABRASIVE POLISHING PAD

(75) Inventors: Vilas N. Koinkar, Wilmington, DE (US); Reza Golzarian, Santa Clara, CA (US); Matthew VanHanehem, Bear, DE (US); Qiuliang Luo, Newport Beach, CA (US); James Shen, Portland, OR (US); Peter A. Burke, Avondale, PA (US)

(73) Assignee: Rodel Holdings, Inc., Wilmington, DE (US)

( * ) Notice: Subject to any disclaimer, the term of this patent is extended or adjusted under 35 U.S.C. 154(b) by 16 days.

(21) Appl. No.: 09/754,424

(22) Filed: Jan. 4, 2001

Related U.S. Application Data

(60) Provisional application No. 60/174,482, filed on Jan. 4, 2000.

(51) Int. Cl.[7] ..... B24B 49/00

(52) U.S. Cl. ..... 451/21; 451/56; 451/443

(58) Field of Search ..... 451/56, 9, 10, 451/11, 443, 21, 22

(56) References Cited

U.S. PATENT DOCUMENTS

| | | | | |
|---|---|---|---|---|
| 5,486,131 A | | 1/1996 | Cesna et al. | |
| 5,692,950 A | | 12/1997 | Rutherford et al. | |
| 5,725,417 A | | 3/1998 | Robinson | |
| 5,842,912 A | | 12/1998 | Holzapfel et al. | |
| 5,885,137 A | * | 3/1999 | Ploessl | 451/56 |
| 6,113,462 A | * | 9/2000 | Yang | 451/5 |
| 6,293,845 B1 | * | 9/2001 | Clark-Phelps | 451/5 |

* cited by examiner

*Primary Examiner*—Eileen P. Morgan
(74) *Attorney, Agent, or Firm*—Gerald K. Kita; Konrad Kaeding; Kenneth A. Benson

(57) ABSTRACT

The present invention relates to methods for break-in and conditioning polishing pads containing a fixed abrasive matrix. The polishing pads are useful for chemical-mechanical polishing (CMP). The present invention also relates to a method of determining the wear rate of a fixed abrasive polishing pad.

2 Claims, No Drawings

METHODS FOR BREAK-IN AND CONDITIONING A FIXED ABRASIVE POLISHING PAD

This application claims the benefit of U.S. provisional application No. 60/174,482, filed Jan. 4, 2000.

FIELD OF THE INVENTION

The present invention relates to methods for break-in and conditioning polishing pads, specifically fixed abrasive polishing pads. The polishing pads are useful for chemical-mechanical polishing (CMP) of metal films and /or lines such as copper, tungsten, aluminum, tantalum/tantalum nitride, titanium/titanium nitride, platinum, and dielectric films and/or lines such as silicon dioxide and polymer and semiconductor substrates.

The present invention also relates to a method of determining the wear rate of a fixed abrasive polishing pad.

DESCRIPTION OF RELATED ART

Semiconductor wafers having integrated circuits fabricated thereon must be polished to provide a very smooth and flat surface which in some cases may vary from a given plane by as little as a fraction of a micron. Such polishing is usually accomplished in a chemical-mechanical polishing (CMP) operation utilizing a chemically active slurry with abrasive particles that is buffed against the wafer surface by a polishing pad. A conventional polishing slurry contains appropriate chemistry and abrasive particles that facilitate the removal of materials both mechanically and chemically with a conventional pad.

Alternatively, a polishing pad containing a fixed abrasive can be used. A fixed abrasive pad incorporates the abrasives into the pad using a resin. Thus, the polishing solution accompanying this pad does not require abrasive particles. In other words, a solution comprised of appropriate chemistry in the absence of abrasives can be used to remove the materials chemically while the mechanical abrasion can be obtained from the relative motion of the pad with abrasives to the wafer in the presence of pressure.

As with most polishing pads, fixed abrasive polishing pads require break-in and conditioning to achieve consistent polishing results. Break-in and conditioning are techniques that modify the surface topography of the fixed abrasive pad to bring the pad within an optimized CMP process window. Break-in is used to prepare a fixed abrasive polishing pad for polishing. Conditioning is used after a polishing pad has been used for polishing. During the polishing process, the surface and polishing properties of polishing pads can change. The topography of the polishing pad surface can be worn down and the surface can become smooth as polishing by-products such as removed wafer material become embedded in the surface. The overall performance of the polishing pad can, consequently, deteriorate and fall out of the optimized process window. Conditioning is used to restore the polishing pad's properties and thereby bring it back within the optimized process window.

Break-in and conditioning are both techniques aimed at affording a polishing pad with stable removal rates and better uniformity. Conditioning generally involves making passes or sweeps over the polishing surface of the pad with an abrasive material that removes a thin layer of pad material and, if present, polishing by-products. U.S. Pat. No. 5,486,131 describes an abrasive conditioning technique that is suitable for use with a conventional polyurethane polishing pad such as IC-1000 that is available from Rodel, Inc., of Newark, Del.

A new generation of fixed abrasive polishing pads is currently being developed. New generation fixed-abrasive polishing pads have a planarizing surface with exposed abrasive particles. The planarizing surface on some abrasive pads has a pattern of topographical features. One type of fixed abrasive polishing pad is described in U.S. Pat. No. 5,692,950. This polishing pad comprises a three-dimensional, textured, fixed abrasive element; at least one resilient element generally coextensive with the fixed abrasive element; and at least one rigid element generally coextensive with and interposed between the resilient element and the fixed abrasive element. Generally, the fixed abrasive element is a fixed abrasive article comprising a backing on which is disposed an abrasive coating comprising a plurality of abrasive particles dispersed in a binder in the form of a predetermined pattern.

One method of conditioning polishing pads is to abrade them with a conventional diamond-embedded abrasive disk. However, U.S. Pat. No. 5,725,417 notes that, although conventional diamond-embedded abrasive disks are well suited to condition conventional polishing pads, they are not well suited to condition the new generation fixed abrasive polishing pads. U.S. Pat. No. 5,725,417 indicates that when a fixed abrasive polishing pad is conditioned with a diamond-embedded abrasive disk, the diamonds not only remove waste material, but they also remove some of the abrasive particles and damage the topographical features on the polishing surface of the pad. Clearly such a result is not desired.

In view of this, U.S. Pat. No. 5,725,417 describes a method of conditioning a fixed abrasive polishing pad by diffusing a conditioning fluid into the suspension medium of the polishing pad in order to form a discrete stratum of material on the suspension medium that is soluble in a wash fluid. The discrete stratum is then removed by dissolving it in a wash fluid, thereby leaving a new polishing surface on the suspension medium.

Since most manufacturers already use conventional conditioning equipment, it would be useful to discover a method of break-in and conditioning using this equipment. It is, therefore, desirable to discover alternative methods of break-in and conditioning fixed abrasive polishing pads that do not damage its topographical features, use conventional equipment, and that are simple, efficient, and effective.

SUMMARY OF THE INVENTION

The present invention provides a method of break-in and conditioning a fixed abrasive polishing pad using a conditioning element, wherein the element, comprises: an upper surface and a lower conditioning surface, comprising: abrasive particles.

Also provided is a method of determining the wear rate of a fixed abrasive polishing pad without using conventional abrasive tests.

DESCRIPTION OF THE PREFERRED EMBODIMENTS

The present invention provides a method of break-in and conditioning fixed abrasive polishing pads using a conditioning element, usually a conventional conditioning element. Break-in is used to prepare the polishing pad prior to polishing. Breaking-in a fixed abrasive polishing pad reduces the friction between the polishing pad and substrate to be polished, increases the surface roughness of the polishing pad, and removes any surface film that may have formed during the manufacturing of the polishing pad.

Conditioning is used to regenerate the polishing pad after polishing numerous wafers. Both types of conditioning have the same general goal in mind, to provide a polishing pad that falls within an optimized process window (i.e., a pad that provides stable removal rates and uniform polishing).

The conditioning element comprises a flat device comprising an upper surface that is attachable to conventional conditioning equipment (e.g., a mechanical arm) and a lower surface that is a conditioning surface. In order to effect conditioning, it is necessary for relative movement between the conditioning element and the polishing pad, or both. As a result one or both of the element and pad should be in motion relative to one another. Preferably, both the conditioning element and the polishing pad are rotated. Preferably, both the conditioning element and the polishing pad are rotated in the same direction. As one of ordinary skill in the art recognizes, it is the mechanical arm or holder that imparts movement (e.g., radial and/or rotational) to the conditioning element.

Conditioning elements are usually considerably smaller in diameter compared with the polishing pad they are conditioning. As a result, the conditioning equipment holding the conditioning element in contact with the polishing pad radially sweeps the element from the center of the polishing pad to the edge and back to the center. Such conditioning is hereinafter referred to as bi-directional conditioning. In contrast, a preferred method of conditioning is unidirectional conditioning. In uni-directional conditioning, the element is radially swept from the center to the edge of the polishing pad. If an additional sweep is desired, the element is lifted off the pad, returned to the center, contacted with the pad again, and then again swept to the edge of the pad. A significant advantage of uni-directional conditioning is that the particulate matter removed from the polishing pad is swept to the edge and then off the pad.

The conditioning element used herein is an element sufficient to break-in and/or condition a fixed abrasive polishing pad. In other words, a conditioning element suitable for the present invention is one that will modify a fixed abrasive polishing pad to provide a pad that falls within an optimized process window. The conditioning element is not limited with regard to its shape, particle type or types, particle size, surface topography, particle pattern, or modifications made to the element surface or particles. For example, the conditioning element may contain grooves in a circular, linear, or grid pattern. Also, the particles may be present on the conditioning element in a circular, linear, grid, or random pattern and there may be more than one type of particle present.

The conditioning surface of the conditioning element comprises abrasive particles. These particles are of a sufficient hardness as to effect break-in and conditioning. Preferably, the particles are diamond, silicon carbide, titanium nitride, titanium carbide, alumina, alumina alloys, or alumina coated with a hard material film, more preferably diamond. A preferred method of adhering diamond particles to the conditioning surface is chemical vapor deposition (CVD). How the particles are attached to the surface of the conditioning element is, however, not to be limited. For example, the particles may be applied to the surface of the conditioning element (e.g., via CVD), may be a part of the surface itself, or may even be embedded in the surface.

Preferably, the conditioning element is in the shape of a disk. The diameter of the conditioning element is only limited to that which is sufficient to provide break-in or conditioning. Preferably the conditioning element is a disk having a diameter of about 1 to 16 inches. More preferably, the disk has a diameter of from 1, to 4 inches. Conditioner disks 22535, 22550, 23515, 23535 and 23550 manufactured by Dimonex, Inc., Allentown, Pa. were found to be useful in the present invention. Diamond particles were used as abrasive particles on these conditioner disks. Another preferred conditioning element is a disk with its central portion removed (i.e., a ring or donut shape). The width of the ring conditioning element is preferably from 0.5 to 2 inches. The diameter of the ring conditioning element is preferably about 1 to 16 inches.

Still another preferred conditioning element is a disk wherein the abrasive particles are present only at the outer edge of the disk. In other words, there is a ring of abrasive particles present on the conditioning disk. Preferably, this ring of conditioning particles has a width of about 0.5 to 2 inches. The diameter of this type of disk conditioning element is preferably about 1 to 16 inches.

Abrasive particle diameter can affect how much material the conditioning element removes with each sweep. As a result, if is preferable for the abrasive particles to have a diameter of from 1 to 50 microns. More preferably, the abrasive particles have a diameter of from 25 to 45 microns. Even more preferably, the abrasive particles have a diameter of about 35 microns.

Polishing pad conditioning is also dependent on the number of abrasive particles present on the surface of the conditioning element (i.e., the particle density). Accordingly, the abrasive particles are disposed on the conditioning surface at a density of from about 5 to 100 particles/mm$^2$ of the element surface. More preferably, the density is from about 40 to 60 particles/mm$^2$. Even more preferably, the density is about 50 particles/mm$^2$.

As one of ordinary skill in the art recognizes, the conditioning element is contacted with the polishing pad and some force or down pressure is applied. The amount of force or down pressure will affect the amount of conditioning that occurs. Preferably, the down force applied to the conditioning element is about 0.5 or 6 lbs. More preferably, the down force is about 1, 2, or 3 lbs. Even more preferably, the down force is 2 lbs.

Another aspect of break-in and conditioning is the number of sweeps performed. As one of ordinary skill in the art recognizes, the more sweeps, the greater the conditioning or the amount of polishing pad surface that is removed. Preferably, 1 to 50 sweeps are performed for break-in. More preferably 1 to 10 sweeps are performed for break-in. Even more preferably, 1 to 5 sweeps are performed for break-in. Preferably, 1 to 50 sweeps are performed for conditioning the polishing pad. More preferably 1 to 10 sweeps are performed for conditioning. Even more preferably, 1 to 5 sweeps are performed for conditioning.

Surface temperature of polishing pad during polishing is used to monitor the pad break-in, conditioning and polishing process stability. For polishing pad break-in and conditioning, conditioning element is swept until the polishing pad surface temperature stability is achieved for run-to-run process performance. Any drift in surface temperature of polishing pad is also used to determine an interval between pad conditioning. Pad conditioning is performed when the temperature drift from preset stable process limits.

An important aspect of break-in and conditioning is the amount of fixed abrasive polishing pad material that is removed. Preferably, from about 0.2 to 3.0 microns of polishing pad are removed during break-in. More preferably, from about 1 to 3.0 microns are removed during break-in. Even more preferably, from about 1.5 to 3.0 microns are removed during break-in. Preferably, from about 0.2 to 3.0 microns of polishing pad are removed during conditioning. More preferably, from about 1 to 3.0 microns are removed during conditioning. Even more preferably, from about 1.5 to 3.0 microns are removed during conditioning.

A preferred fixed abrasive polishing pad to be used in the present invention is a fixed abrasive polishing pad like that described in U.S. Pat. No. 5,692,950, the contents of which are incorporated herein by reference. This type of polishing pad can be a continuous pad or a typical individual pad (e.g., circular). This fixed abrasive polishing pad comprises a three-dimensional, textured, fixed abrasive element, a resilient element, and a rigid element interposed between the resilient element and the fixed abrasive element. Generally, the fixed abrasive element is a fixed abrasive article comprising a backing on which is disposed an abrasive coating comprising a plurality of abrasive particles dispersed in a binder in the form of a pre-determined pattern. Typically this type of pad contains a pattern of raised areas (e.g., posts or pyramids). It is this pattern that conventional conditioning procedures typically damage. Preferably the raised areas are posts that cover about 18% of the surface of the pad. Preferably the posts are about 200 $\mu$m in diameter and about 30 to 40 $\mu$m in height. As a consequence of the manufacturing process, there is usually about a 10 $\mu$m depression between posts.

It is another aspect of the present invention to modify the surface topography of the raised areas (e.g., posts) in a controlled manner. Typically, a fixed abrasive polishing pad has a surface roughness of about 0.2 $\mu$m after it is manufactured. It is desirable to increase this roughness prior to polishing. Surface roughness, as used herein, is intended to mean root mean square deviation of the profile from the mean line. The mean line is the height where the area above and below the mean line is equal. Surface roughness increases after break-in and conditioning. Preferably, the present invention, after break-in or conditioning, yields a surface roughness of from about 0.2 to 1.5 $\mu$m. More preferably, the resulting surface roughness is from about 0.5 to 1.0 $\mu$m.

Typically, a fixed abrasive polishing pad has a Peak-to-Valley distance of about 2 $\mu$m after it is manufactured. It is desirable to increase this Peak-to-Valley distance prior to polishing. Peak-Valley distance, as used herein, is the distance between the highest and lowest points within the measured area. Peak-to-Valley distances, like surface roughness, increase after break-in and conditioning. Preferably, the present invention, after break-in or conditioning, provides a Peak-to-Valley distance of from about 1 to 20 $\mu$m. More preferably, the resulting Peak-to-Valley distance is from about 4 to 8 $\mu$m.

With fixed abrasive polishing pads, conventional abrasive tests are not reliable in determining the wear rate of pads from different manufacturing lots. Specifically, conventional abrasive tests are unable to reliably distinguish between different lots of fixed abrasive polishing pads. The present invention solves this problem by providing a method of determining the wear rate of a fixed abrasive polishing pad. Knowing the wear rate of a specific manufacturing lot of pads allows one to determine some or all of the following items of interest: (1) how long the pads will last, (2) how many conditioning sweeps will be necessary to break-in and condition the pad, (3) when and how often the pads will need to be conditioned, (4) how to control the fixed abrasive manufacturing process, (5) the variations in hardness of fixed abrasive pads, (6) the bonding strength between abrasive particles and resins used in fixed abrasive pads, and (7) what the current manufacturing lot of pads would be most suited to polish.

The present method of determining pad wear rates involves measuring the height of the raised area (e.g., the posts) of a polishing pad. An optical interferometer, non-contact optical profilometer, or a stylus profiler can be used to measure these heights. Once the average post height of a pad has been determined, the pad is then subjected to one sweep of a conditioning element. The average post height is then determined and a rate of post material loss is calculated. Additional data can be obtained by conducting additional sweeps and additional height measurements. Preferably, 1, 2, 3, 4, or 5 sweeps are conducted. Preferably, the conditioning sweep is conducted with an element having 25 to 35 micron diameter particles at a density of 50 particles/mm$^2$ under 4 pounds of force.

Obviously, numerous modifications and variations of the present invention are possible in light of the above teachings. It is therefore to be understood that within the scope of the appended claims, the invention may be practiced otherwise than as specifically described herein.

What is claimed:

1. A method of determining the wear rate of a fixed abrasive polishing pad, comprising:

measuring the average height of the raised area of the polishing pad;

contacting the polishing pad with a conditioning element;

performing one or more unidirectional sweeps of the conditioning element on the polishing pad;

measuring the average height of the raised area of the polishing pad after each conditioning sweep; and, calculating the rate of material removed or loss from post surface per sweep.

2. A method according to claim 1, wherein the raised area is in the shape of a post, the height of the raised area is determined by an optical interferometer, non-contact optical profiler or a stylus profiler, and the conditioning sweep is conducted with an element having 35 micron diameter particles at a density of 50 particles/mm$^2$, and under 4 pounds of force.

* * * * *